US005206958A

United States Patent [19]

Widenback

[11] Patent Number: 5,206,958

[45] Date of Patent: May 4, 1993

[54] PROTECTION SUIT COMPRISING A PONCHO-LIKE PART AND A PROTECTIVE HOOD JOINED THERETO AND A METHOD OF MANUFACTURING THE SAME

[75] Inventor: Ralph Widenback, Stenungsund, Sweden

[73] Assignee: New Pac Systems AB, Sweden

[21] Appl. No.: 800,998

[22] Filed: Dec. 2, 1991

[30] Foreign Application Priority Data

Dec. 3, 1990 [SE] Sweden ..... 9003847

[51] Int. Cl.[5] ..... A41D 3/08

[52] U.S. Cl. ..... 2/88; 2/84; 2/85; 2/2; 2/69; 2/202; 2/243 R

[58] Field of Search ..... 2/88, 89, 84, 202, 243 R, 2/2, 85, 69, 69.5

[56] References Cited

U.S. PATENT DOCUMENTS

| | | | |
|---|---|---|---|
| 2,631,289 | 3/1953 | Herrington | 2/84 |
| 3,781,916 | 1/1974 | Vitol | 2/88 |
| 3,849,803 | 11/1974 | Connors | 2/88 |
| 4,370,755 | 2/1983 | Crumby | 2/88 |

FOREIGN PATENT DOCUMENTS

| | | | |
|---|---|---|---|
| 0026151 | 1/1981 | European Pat. Off. | 2/88 |

*Primary Examiner*—Clifford D. Crowder
*Assistant Examiner*—Gloria Hale
*Attorney, Agent, or Firm*—Ostrolenk, Faber, Gerb & Soffen

[57] ABSTRACT

A protection suit for civilian or military use comprises a poncho-like part and a protective hood joined thereto. The poncho-like art of the protection suit consists of a flat sheet of thermoplastic material folded double and provided with an opening in the front sheet portion. The protective hood is prefabricated out of two flat sheet portions of thermorplastic joined together along a continuous weld seam and having openings. The opening in the back sheet portion of the protective hood is the same shape and size as the opening in the poncho-like part and the defining edges of two openings are welded together by means of a continuous seam. The protection suit can be manufactured entirely in a two-dimensional plane.

11 Claims, 5 Drawing Sheets

FIG.1
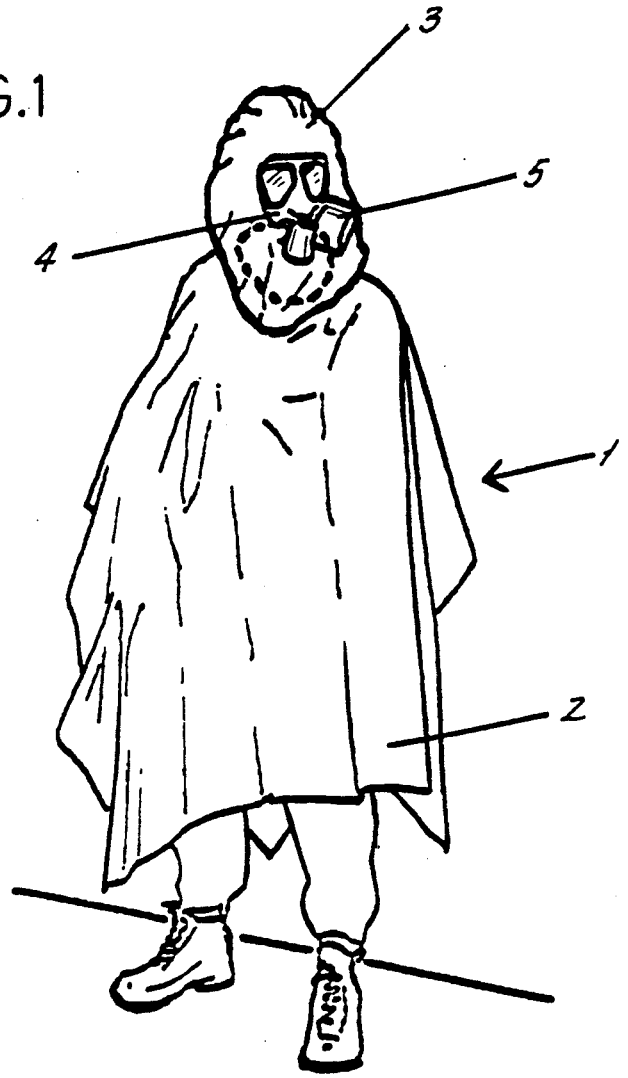
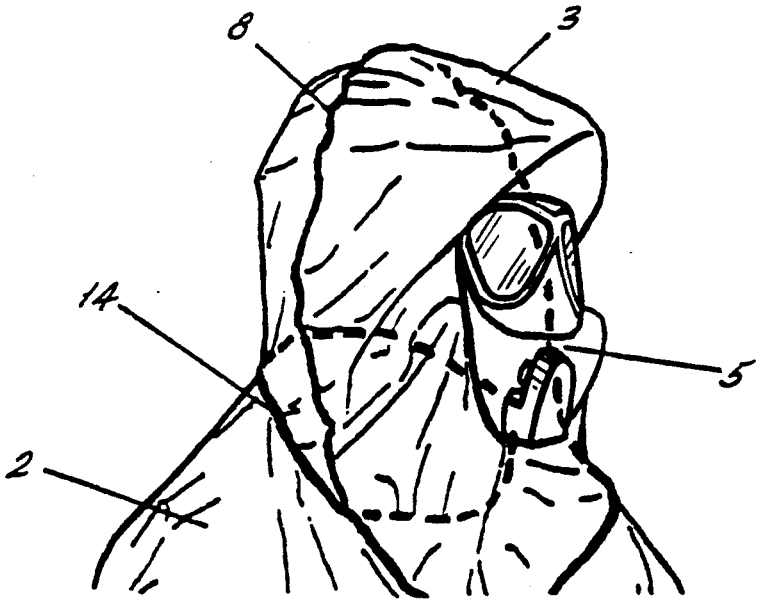
FIG.2

FIG. 3
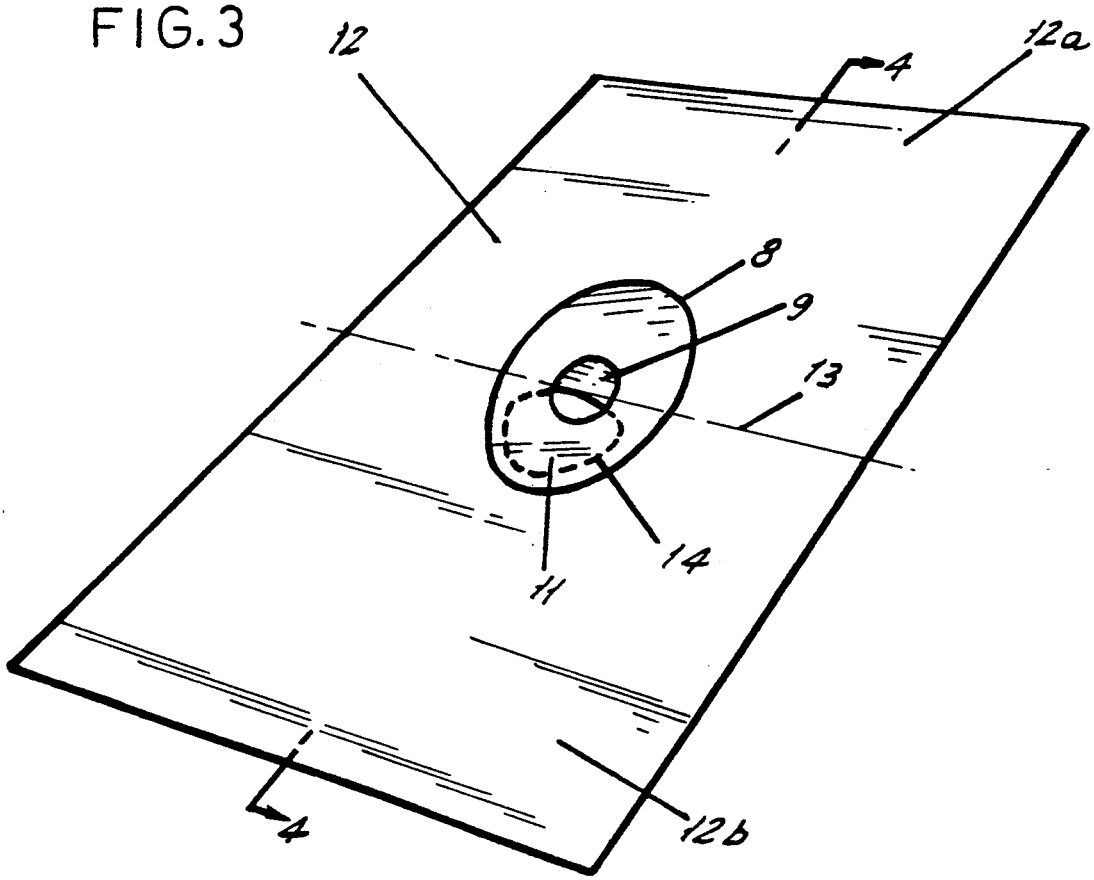
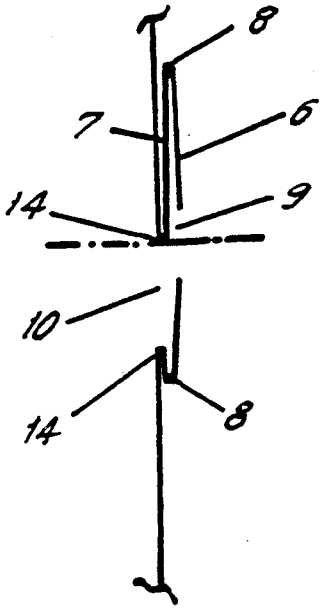
FIG. 4

PROTECTION SUIT COMPRISING A PONCHO-LIKE PART AND A PROTECTIVE HOOD JOINED THERETO AND A METHOD OF MANUFACTURING THE SAME

BACKGROUND OF THE INVENTION

1. Field of the Invention

The present invention relates to a protection suit comprising a poncho-like part and a protective hood joined thereto, and also to a method of manufacturing such a protection suit.

2. Description of the Related Art

A poncho or cape is usually in the form of a rectangular, flat sheet with a slit or opening for the head. When the flat sheet is worn it hangs down from the shoulders, over the arms, covering the entire upper body.

The fundamental idea of such a poncho is thus, with extremely simple and inexpensive means, to be able to produce an article of clothing to provide protection against rain and cold, for instance.

These garments have been developed to provide protection for the head also, by sewing on a hood. However, the original product thus becomes considerably more expensive due to the extra work step required to join the various work pieces.

Traditional mass-production of collars, necks and hoods is achieved by joining flat work pieces, the meeting edges of which are the same length but of different shape, thereby giving the flat sheet a third dimension. A shape fitting the body is thus obtained, but at the price of complicated manufacturing technology, several work steps and increased difficulty in packing such products flat to minimize their volume.

Ponchos of various types are sometimes used as protective equipment by the armed services. They must therefore be extremely inexpensive to manufacture in large quantities, packable to absolutely minimum volume and must be of a material weighing as little as possible. Such a product, besides its function as personal protection, must sometimes also be suitable for combination with larger expanses of material to protect tents and other equipment.

The construction of the protective hood and the manner in which it is joined to a poncho produced from a flat sheet of material is however of decisive significance as to whether such a product is cheap to manufacture or not, without its function being lost.

Chemical warfare places further demands on the construction of such protection suits, and particularly on the design of the protective hood so that it is able to seal efficiently against a protective mask while still permitting certain movement of the head. Such a protective hood must thus give complete coverage around the neck and the whole head, but yet leave room for both a helmet and a protective mask.

SUMMARY OF THE INVENTION

It has now proved possible to solve the above problem by means of the protection suit according to the invention, in which the welding steps for joining the protective hood to the poncho are without exception performed in a flat geometric procedure and the whole product retains the flat sheet principle even when the protective hood has been welded on. This offers considerable manufacturing advantages and allows the product to be packed flat with a minimum volume, despite the fact that the protective hood assumes a roomy, three-dimensional form which entirely covers the head when in use, with space for both a helmet and a tightly fitted protective mask, as well as allowing the head to be turned to a desired extent.

This is achieved in a protection suit as described in the introduction substantially in that

- the poncho-like part of the protection suit consists of a front and a back flat sheet portion of thermoplastic material joined together along a connecting line located at their upper edges, the front sheet portion being provided with an opening close to the connecting line,
- the protective hood consists of a front and a back flat sheet portion of thermoplastic material joined together by means of a continuous peripheral weld seam, each sheet portion being provided with an opening, the opening in the back sheet portion of the protective hood having the same shape and dimension as the opening in the front sheet portion of the poncho-like part,
- and the back sheet portion of the protective hood is joined to the sheet portion of the poncho-like part by means of a continuous weld seam running along the edges of the openings arranged in these two sheet portions.

The poncho-like part may suitably consist of a single flat sheet folded double to form the front and back sheet portions of said part. The connection line at the upper edges of these two sheet portions is thus formed by the fold line in said flat sheet. Alternatively the two flat sheet portions of the poncho-like part may instead consist of two separate flat sheet pieces joined together by means of a weld seam at their upper edges.

According to a suitable embodiment of the invention the sheet portions forming the protective hood are substantially oval in shape.

The thermoplastic material used may suitably be polyethylene possibly with a gastight layer of polyamide.

The protection suit according to the invention may suitably be manufactured by

- producing a protective hood by placing a front and a back flat sheet portion of thermoplastic material, each sheet portion being provided with an opening, placing the sheets, one on top of the other and joining them together by means of a continuous peripheral weld seam,
- providing a front sheet portion of thermoplastic material for a poncho-like part of the protection suit with a central opening close to its upper edge, said central opening having the same shape and dimension as the opening in the back sheet portion of the protective hood,
- joining the back sheet portion of the protective hood to the front sheet portion for the poncho-like part by means of a continuous weld seam running along the edges of the openings arranged in these two sheet portions,
- and then placing a back sheet portion for the poncho-like part behind the front sheet portion for said part, and preferably welding these two sheet portions together along all or most of their side edges.

Other features and advantages of the invention will become apparent from the following description of a preferred embodiment of the invention, with reference to the accompanying drawings.

BRIEF DESCRIPTION OF THE DRAWINGS

FIG. 1 shows a view in perspective of a protection suit according to a first embodiment of the invention, FIG. 2 shows a view in perspective of the protective hood, FIG. 3 shows a view from above of the first step in manufacturing the protection suit according to the invention, FIG. 4 shows a section along the line IV—IV in FIG. 3.

DETAILED DESCRIPTION OF THE PREFERRED EMBODIMENT

Figure 5:
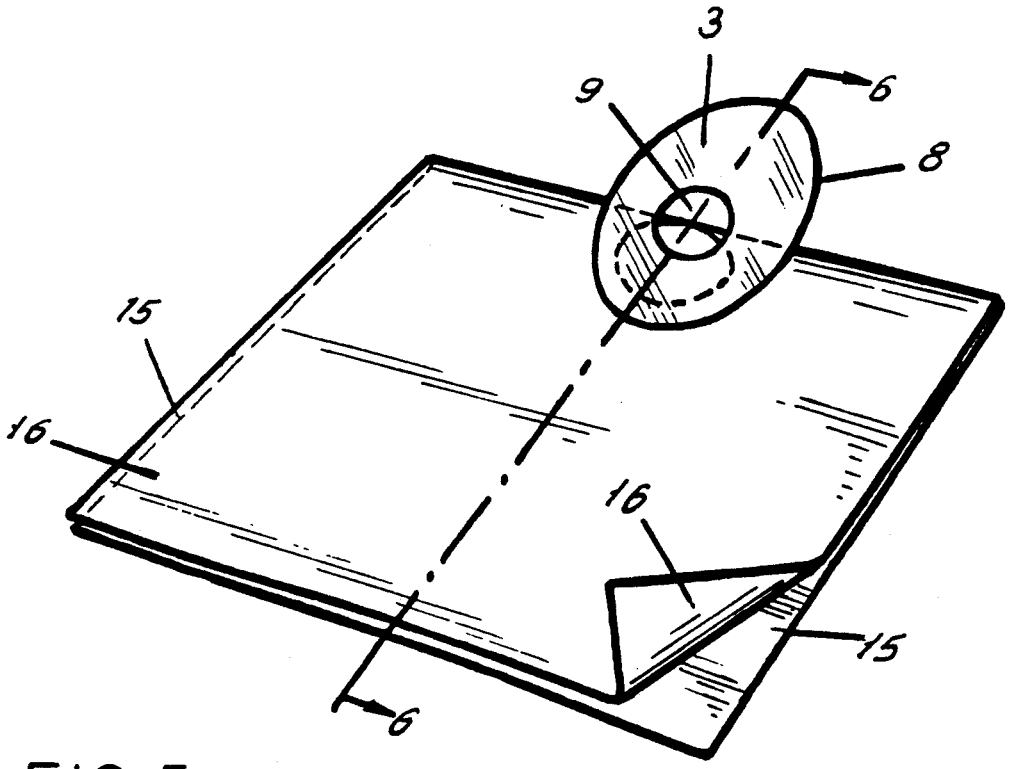
FIG. 5 shows a view from above of the second manufacturing step to produce the poncho-like part of the protection suit.
Figure 6:
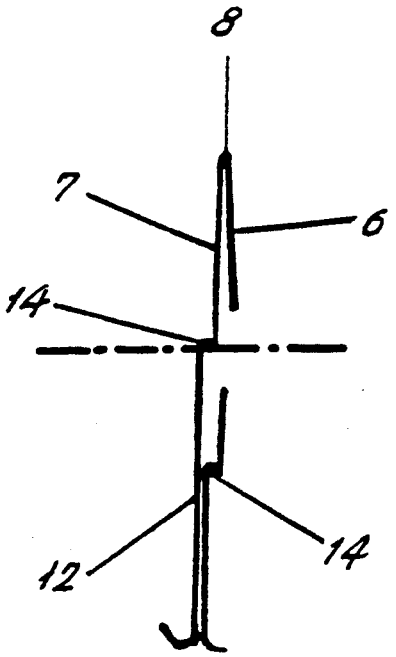
FIG. 6 shows a section along the line VI—VI in FIG. 5.

The protection suit shown in FIGS. 1–6 is designated generally by 1 and comprises a poncho-like part 2 and a protective hood 3 forming an integral part thereof.

The poncho-like part 2 and the protective hood 3 of the protection suit 1 are suitably manufactured from a relatively thin thermo-plastic material with or without a gastight barrier layer. The thermo-plastic material suitably consists of polyethylene or a laminate and a gastight layer of polyamide, for instance.

The protection suit 1 shown is specifically designed for military use and the protective hood 3 therefore has an opening for an elastic fit around the filter, exhaling valve and eye-piece of a protective mask 5, which is thus otherwise entirely covered by the protective hood 3.

The protection suit according to the invention is manufactured as follows;

The protective hood 3 itself is suitably prefabricated out of two separate flat sheet portions 6, 7 which are welded together along their outer edges by a continuous weld seam 8. The front sheet portion 6 has an opening 9 punched in it, through which the filter, breathing valve and eye-piece of the protective mask 5 protrude when the protection suit is in use. A second opening 10 is punched in the corresponding back sheet portions of the protective hood 3, corresponding in dimension and shape to a corresponding opening 11 punched in a considerably larger flat sheet 12 which is to be the poncho-like part 2 of the protection suit 1.

The flat sheet 12 is preferably rectangular in shape and is intended to be folded along its mid-line 13 in order to form the poncho-like part 2. A back sheet portion 12*a* and a front sheet portion 12*b* will thus be formed for the part 2. The opening 11 is suitably located below the mid-line 13 and so that it forms a tangent with this in the front sheet section 12*b* formed by one half of the sheet.

The protective hood 3, prefabricated as described above, is welded to the sheet portion 12*b* before the sheet 12 is folded, the defining edge of the opening 10 being welded together with the defining edges of the opening 11 by means of a continuous weld seam 14. The sheet portion 12*a* is then folded towards the sheet portion 12*b* along the fold line 13, and the double sheet thus obtained is welded together along the side edges 15, 16.

Figure 7:
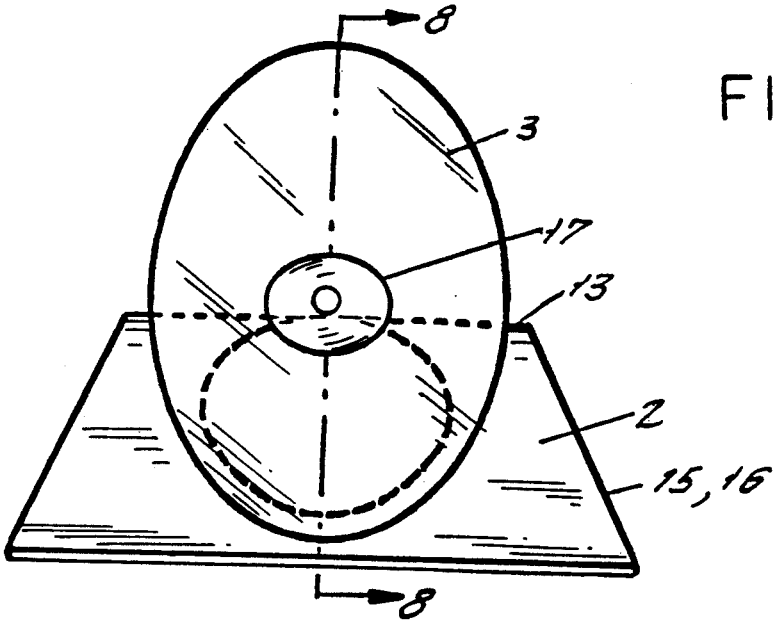
FIG. 7 shows a view from above of a protection suit according to a second embodiment of the invention.
Figure 8:
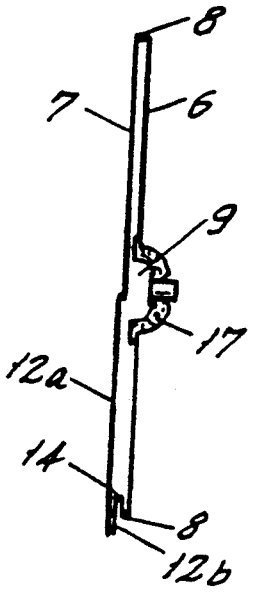
FIG. 8 shows a section along the line VIII—VIII in FIG. 7.

FIGS. 7 and 8 show a protection suit somewhat modified designed in comparison with that described above and shown in FIGS. 1–6. The general design agrees, however, in the two embodiments of the protection suit. Corresponding elements in the two embodiments have therefore been given the same reference designations.

A first difference between the two embodiments is that the front and back sheet portions 12*b* and 12*a* of the poncho-like part 2 of the protection suit according to FIGS. 7 and 8 are considerably shorter than in the protection suit shown in FIGS. 1–6. They also become narrower towards their upper ends.

Another difference is that the opening 9 in the front sheet portion 6 of the protective hood 3 contains a respirator 17 fitted mechanically and sealingly therein. This respirator is of generally bowl-like shape and can be clamped to the user's head and moulded to contact the user's face around his (her) nose and mouth. The respirator 17 may be of similar design to the masks used for spray-varnishing, which consist largely of an inhaling filter with active carbon, provided with an exhaling valve fitted centrally in this filter. The respirator 17 is provided at its rear, wider end with a protruding, peripheral flange located in contact with the rear side of the front sheet portion 6, at the edge of the opening 9 and is joined to said portion by a weld seam. At least the front sheet portion 6 here should be transparent to allow for seeing through the same.

To permit sealing between the protection suit and the user's neck, and thereby separation of the space located outside the respirator, within the protective hood 3, from the external surroundings, a ribbon may be tied around the protective hood 3 at the seam 14 between this and the front sheet portion 12*b* of the poncho-like part 2. This ribbon may be a permanent part of the protection suit or may be packed together with it as a separate accessory.

Figure 9:
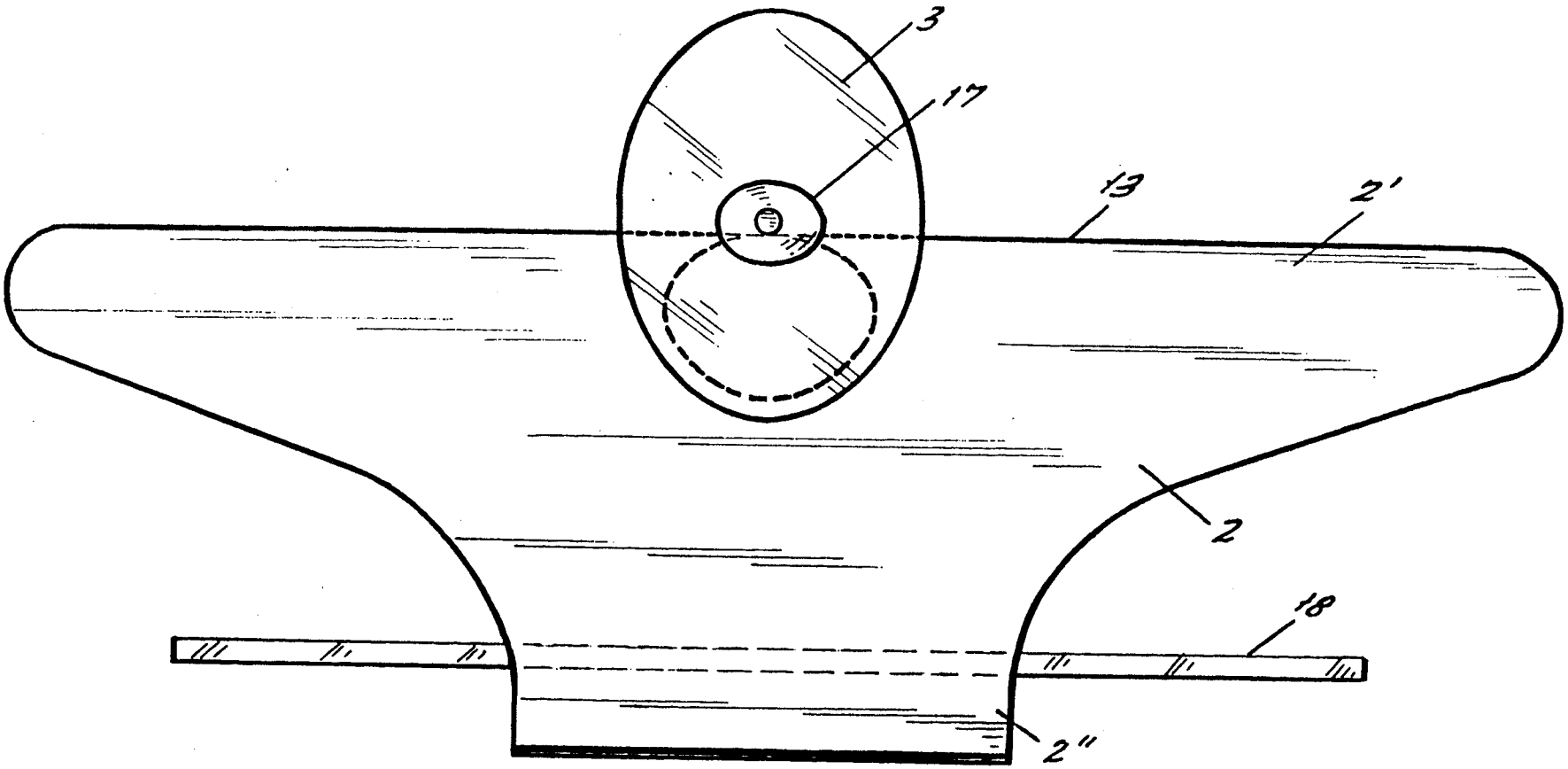
FIG. 9 shows a view from above of a protection suit according to a third embodiment of the invention.

FIG. 9 shows a protection suit according to a third embodiment. This differs from the protection suit according to FIGS. 7 and 8 in the shape of the poncho-like part 2. According to FIG. 9 this comprises a laterally wider upper part 2′ which at its ends forms a pair of closed sleeves, and an extended lower part 2″ which can reach down over the user's waist and is provided with a ribbon 18 which can be tied tightly around the user's waist. In the embodiment according to FIG. 9 also, a respirator 17 is fitted in the opening 9 in the transparent front sheet portion 6 of the protective hood 3. Furthermore, the front and back sheet portions of the part 2 are tightly joined together both at their upper edges and their side edges.

The protection suits according to the second and third embodiments ensure that a volume of breathable air is obtained inside the protection suits, and thus can be inhaled if drawn into the respirator 17 due to an insufficient seal between this and the user's head.

The invention is of course not limited to the embodiments shown in the drawings, which can be modified in many ways within the scope of the following claims. If the protection suit according to the invention is not intended to be worn over protective mask equipment, nor combined with a respirator, the opening in the front of the protective hood can of course be enlarged. Naturally the protection suit according to the invention can also be used for civilian use.

What is claimed is:

1. A protection suit comprising a poncho-like part and a protective hood, wherein the poncho-like part of the protection suit comprises front and back flat sheet portions of thermoplastic material, each sheet portion having an upper edge, the sheet portions being joined together along a connecting line located at the upper edges of the sheet portions, the front sheet portion being provided with an opening close to the connecting line, the protective hood comprises front and back flat sheet portions of thermoplastic material joined together by means of a continuous peripheral weld seam, each hood sheet portion being provided with an opening, the opening in the back sheet portion of the protective hood having the same shape and dimension as the opening in the front sheet portion of the poncho-like part, and the back sheet portion of the protective hood is joined to the front sheet portion of the poncho-like part by means of a continuous weld seam running along the edges of the openings arranged in the back sheet portion of the protective hood ad in the front sheet portion of the poncho-like part.

2. The protection suit of claim 1, wherein the poncho-like part comprises a single flat sheet folded double to form the front and back sheet portions of said part.

3. The protection suit of claim 1, wherein the front and back sheet portions of the poncho-like part each have side edges and are welded together along all or most of the side edges.

4. The protection suit of claim 1, wherein the sheet portions of the protective hood are substantially oval in shape.

5. The protection suit of claim 1, wherein the weld seams are located eccentrically in relation to each other when the protection suit is laid flat.

6. The protection suit of claim 1, wherein the thermoplastic material comprises polyethylene.

7. The protection suit of claim 6, wherein the thermoplastic material comprises a laminate including a gas-tight layer of polyamide.

8. The protection suit of claim 1, wherein a respirator is fitted in the opening arranged in the front sheet portion of the protective hood.

9. A method of manufacturing a protection suit comprising a poncho-like part and a protective hood joined thereto, comprising:

producing a protective hood by placing front and back flat sheet portions of thermoplastic material on top of one another and joining the sheets together by means of a continuous peripheral weld seam and forming an opening having edges in each of said front and back sheet portions, producing a poncho-like part by providing a front and back sheet portion of thermoplastic material each having upper edges forming a central opening close to an upper edge thereof, said central opening having edges and being the same shape and dimension as the opening in the back sheet portion of the protective hood, joining the back sheet portion of the protective hood to the front sheet portion of the poncho-like part by means of a continuous weld seam running along the edges of the openings arranged in the back sheet portion of the protective hood and the front sheet portion of the poncho-like part, and then placing and attaching a back sheet portion for the poncho-like part behind the front sheet portion for said part.

10. The method of claim 9, wherein the two flat sheet portions of the poncho-like part are produced in one piece from a single flat sheet which is folded double after application of the protective hood to the front sheet portion for said part.

11. The method of claim 9, further comprising the step of welding the backsheet and front sheet portions together along upper edges thereof.

* * * * *